United States Patent [19]

Jaeger

[11] 4,064,608

[45] Dec. 27, 1977

[54] COMPOSITE CAST IRON DRIER ROLL

[75] Inventor: Frederick T. Jaeger, Rosemere, Canada

[73] Assignee: Eutectic Corporation, Flushing, N.Y.

[21] Appl. No.: 728,077

[22] Filed: Sept. 30, 1976

[51] Int. Cl.[2] ..... B32B 15/18

[52] U.S. Cl. ..... 29/132; 427/34; 427/236; 428/457; 428/678; 428/679; 428/684

[58] Field of Search ..... 29/132, 196.1, 196.3, 29/196.6; 165/89; 34/85, 119; 427/236, 34; 75/0.5 BC; 428/457, 678, 679, 684

[56] References Cited

U.S. PATENT DOCUMENTS

| | | | |
|---|---|---|---|
| 2,576,036 | 11/1951 | Ostertag et al. | 165/89 |
| 3,378,392 | 4/1968 | Longo | 29/196.6 X |
| 3,455,019 | 7/1969 | Quaas | 29/196.6 X |
| 3,645,861 | 2/1972 | Garvey | 29/196.6 |
| 3,754,968 | 8/1973 | Reznik | 29/196.6 X |
| 3,775,241 | 11/1973 | Justus et al. | 34/85 |
| 3,974,555 | 8/1976 | Strohmeier et al. | 29/132 |

*Primary Examiner*—Arthur J. Steiner

*Attorney, Agent, or Firm*—Hopgood, Calimafde, Kalil, Blaustein and Lieberman

[57] ABSTRACT

A drier roll having a ferrous metal surface is provided with a surface coating of a hardfacing alloy, the ferrous metal surface having a thermal conductivity relative to silver taken as 1 cal/cm²/cm/° C/sec of at least about 0.06, the hardfacing alloy being a hardfacing heat, corrosion and wear resistant iron-group metal-base alloy mechanically and metallurgically bonded to said ferrous metal surface which is preferably made of cast iron, the hardfacing alloy coating having a thickness ranging from about 0.01 to 0.15 inch, the thermal conductivity of said coating being at least 0.05.

11 Claims, 6 Drawing Figures

COMPOSITE CAST IRON DRIER ROLL

This invention relates to a composite drier roll comprising a cylindrical ferrous metal surface with a hard-facing alloy mechanically and metallurgically bonded thereto characterized by improved combination of physical and chemical properties, including resistance to heat, corrosion and wear combined with optimum thermal conductivity.

In copending application Ser. No. 672,785, filed Apr. 1, 1976, a boiler tube coating and method are disclosed in which industrial steel tubes or pipes, for example, steel boiler tubes and/or integrated panels of steel boiler tubes, are provided with a fused overlay of a corrosion and erosion resistant coating comprised of a refractory hard component, e.g. tungsten carbide, dispersed through a corrosion resistant matrix alloy.

STATE OF THE ART AND THE PROBLEM

Structural elements of industrial equipment subjected in use to heat and/or corrosion, and/or erosion, including normal wear and tear, such as heat exchanger elements, generally require regular maintenance and care in order to keep the equipment in optimum working condition. Such elements are generally made of ferrous metals (e.g. mild and low alloy steel, cast iron, wrought iron, and the like) and include a variety of structural elements. A particular heat exchange element with which the invention is concerned is a Yankee drier roll used in paper manufacture.

Heretofore, it had been the practice to replace the worn, or corroded, or eroded drier roll with a new roll and, depending upon its availability from the manufacturer, it was not uncommon for the replacement to take an inordinate amount of time, which adds to the overall maintenance cost. Moreover, the cost of replacement rolls has steadily increased due to increasing manufacturing costs aggravated by economic inflation.

The conventional Yankee drier roll generally comprises a cylindrical ferrous metal shell, preferably a cast iron shell, mounted on journals through the medium of dished heads, the shell and heads together forming a unitary cylindrical drum. The drier roll which is generally steam heated functions as a heat exchanger in the drying of wet paper web, such as tissue paper. The wet web of paper is delivered to the surface of the steam heated roll by passing the wet sheet around a large pressure roller which presses the sheet against the revolving heated drier roll, wherein the pressure roller squeezes out fluids and air from the sheet and the sheet thereafter dried as it travels over the surface of the drier roll.

Examples of drier rolls are given in U.S. Pat. Nos. 2,576,036, No. 3,228,462 and No. 3,775,241.

Drier rolls may vary in diameter from about 4 to 30 feet in diameter and about 10 or more feet long. The roll requires an accurately contoured surface to assure optimum thermal contact between the roll and the wet web of paper delivered to it. Thermal conductivity of the ferrous metal shell against which the wet paper web is held is important and, therefore, the ferrous metal surface should have optimum thermal conductivity.

Many ferrous metal substrates, such as cast iron, mild steel, wrought iron, carbon steels, low alloy steels, and the like, exhibit good thermal conductivities of substantially over about 0.06 cal/sq. cm/cm/° C/sec and generally over about 0.08 or 0.1 and ranging as high as about 0.2 (wrought iron) which, in many cases, is important where the metal part is in contact with a heat source for a special purpose, such as the steam heated Yankee drier roll. Cast iron is preferred because of its consistently high thermal conductivity for a ferrous base metal of that type.

When the wet web to be dried is carried on the surface of the drier roll, the outer surface of the roll is cooled below the temperature of the inner surface of the shell or drum such that a temperature gradient exists. Depending on the uniformity of the surface of the shell, a temperature gradient may also exist along the length of the shell or drum. It is important, therefore, that heat flow be as uniform as possible over the working life of the roll so that uniform and substantially rapid drying is assured.

As is general with moving parts and surfaces, the roll surface is subject to normal wear, tear and corrosion and requires frequent grinding to maintain the contour as accurate as possible for the purpose intended. When wear becomes compounded with use and grinding maintenance, there reaches a time when the roll has to be replaced.

Attempts have been made to rework the worn roll by applying a corrosion resistant alloy coating to the surface thereof which is thereafter ground to substantially uniform thickness to provide the required contour. One attempt has been to prepare the surface to receive the alloy coating and flame spray the coating using a wire of 410 stainless steel. Thereafter, the applied coating is then accurately ground to the desired contour.

A disadvantage of the foregoing coating is that it does not have a good life due to wear and also does not dry the paper properly due to its inferior thermal conductivity. Low carbon chromium-containing stainless steels have low thermal conductivities of below 0.06 or 0.05 cal/cm²/cm/° C/sec. Moreover, the coating obtained as above with wire spraying was not dense, was porous and exhibited a stratified structure which further degraded the thermal conductivity. Thus, the coating did not provide the desired protection. Consideration was given to well known nickel-base chromium-bearing alloys, but such alloys do not provide heat conductivities of at least about 0.05 cal/cm²/cm/° C/sec for use on drier rolls.

For example, the alloy known by the trademark "Inconel" (13% to 15% Cr, 6% to 8% Fe and the balance nickel) exhibits a thermal conductivity of about 0.035 at ambient temperature, which is substantially below the heat conductivity of cast iron and low alloy steels. A nickel-base alloy containing 60% Ni, 24% Fe and 16% Cr exhibits a thermal conductivity of 0.032 which is also very low. A cobalt-base alloy containing 25% to 30% Cr, 1.5% to 3.5% Ni, 4.5% to 6.5% Mo, 2% max Fe, 0.2% to 0.35% C and the balance cobalt exhibits a thermal conductivity of about 0.035 at 200° C. An alloy containing 20% to 22.5% Cr, 19% to 21% Ni, 2.5% to 3.5% Mo, 2% to 3% W, 18.5% to 21% Co, 0.75% to 1.25% Nb+Ta, 0.1% to 0.2% N, 0.2% max C and the balance Fe exhibits a thermal conductivity of about 0.035 at 200° C.

On the other hand, substantially pure nickel exhibits a heat conductivity of about 0.22. However, when chromium, for example, 15% or 20%, is added as a solute metal to the solvent or matrix metal nickel, the thermal conductivity of the nickel drops drastically to below 0.05, for example, in the neighborhood of about 0.03 to 0.04 cal/sq. cm/cm°C/sec. For example, an alloy of 80% Ni-20% Cr exhibits a thermal conductivity of about 0.032 at 100° C. Cobalt per se exhibits a thermal conductivity of about 0.165 at ambient temperature. However, when chromium is added as a solute metal in amounts of over 10%, the thermal conductivity is drastically reduced.

Thus, when a heat, corrosion and oxidation resistant alloy coating of low thermal conductivity of substantial thickness is applied to a ferrous metal substrate having a heat conductivity of at least about 0.06, the coating adversely affects the thermal conductivity of the composite assembly and, in the case of a Yankee drier roll, can adversely affect the drying rate with respect to the drying of a paper web due to a decrease in thermal conductivity.

Hardness is an important attribute of a coating since it relates to wear resistance. Thus, it would be desirable to provide composite ferrous metal drier drums having hard dense alloy coatings which are corrosion and wear resistant and which are characterized by a thermal conductivity of at least about 0.05 cal/cm²/cm/°C/ sec.

OBJECTS OF THE INVENTION

An object of the invention is to provide a composite drier roll having a ferrous metal surface with a thermal conductivity of at least about 0.06 cal/cm²/cm/° C/sec and having metallurgically bonded thereto a heat corrosion and wear resistant alloy comprising an iron-group metal-base alloy.

Another object is to provide as an article of manufacture a composite Yankee drier roll having a hard, heat, corrosion and wear resistant iron-group metal-base alloy mechanically and metallurgically bonded to the cast iron substrate and having a thermal conductivity of at least about 0.05 cal/cm²/cm/° C/sec.

These and other objects will more clearly appear when taken in conjunction with the following disclosure and the appended drawings, wherein.

SUMMARY OF THE INVENTION

Figure 1:
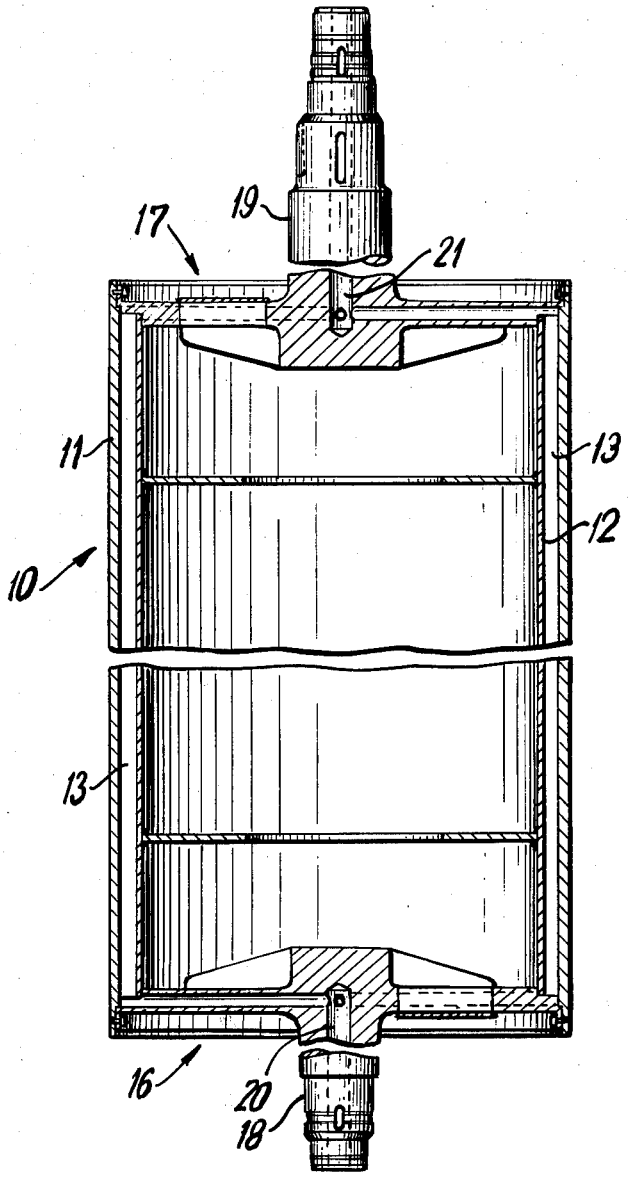
FIG. 1 is representative of a Yankee drier roll in longitudinal cross section.

According to the invention, a hard, corrosion and wear resistant alloy coating is provided for application onto a ferrous metal substrate of a drier roll in which alloying ingredients making up the alloy are judiciously controlled to contain proportions of refractory solute metals, e.g. W, Mo and Cr, etc., which normally substantially adversely affect the heat conductivity of the solvent metal making up substantially the main ingredient of the alloy, that is to say, the base metals Fe, Ni and Co.

It has been found that numerous hardfacing alloys are particularly applicable for carrying out the invention. These alloys are defined as iron-base, nickel-base and cobalt-base alloys (iron-group metals) containing about 0.5% to 5% boron and 0.5% to 6% silicon and up to about 3% carbon in combination with strong carbide and boride formers selected from the group of solute metals mentioned hereinabove, to wit: the refractory metals W and/or Mo and/or Cr. An advantage of the foregoing alloys is that they provide good coatings which are hard and provide optimum resistance to wear. The balance of the alloy is essentially the iron-group metal.

By judiciously controlling the relationship between the refractory solute metals when present, particularly chromium, and the boron and carbon present in the coating alloy, the amount of refractory solute metal going into solution with the solvent metal Fe, Ni or Co can be kept to below the amount that substantially adversely affects the thermal conductivity of the solvent metal, such as nickel. For example, an alloy of 15% Cr, 7% Fe and the balance Ni has a relatively low thermal conductivity (about 0.035) because of the presence of Cr and Fe. By lowering the amount of Cr dissolved in the nickel matrix by converting a substantial portion of the chronium to a carbide or boride so that it is removed from solid solution with the nickel, the thermal conductivity of the alloy can be upgraded to at least about 0.05 and higher and still provide a metal coating characterized by improved resistance to erosion, corrosion, wear and oxidation.

Assuming the alloy is a nickel-base alloy containing by weight 20% Cr and 80% Ni, the addition of about 3% C and 2% B will consume a substantial portion of the chromium in forming the carbide $Cr_3C_2$ and the boride CrB, the solute chronium in the compounds being in equilibrium with the residual chromium in the solvent nickel, taking into account the law of mass action.

What has been said as regards chromium applies equally to the refractory solute metals tungsten and molybdenum. One embodiment of the invention is directed to an alloy coated ferrous metal drier roll in which the ferrous metal substrate has a heat conductivity relative to silver taken as 1 at substantially ambient temperature of at least about 0.05 calories/ sq.cm.cm/° C/sec, the alloy coating being a heat and corrosion resistant iron-group metal-base alloy mechanically and metallurgically bonded to the ferrous metal substrate and having a thickness ranging from about 0.01 to 0.15 inch, e.g. 0.01 to 0.08 inch thick and preferably 0.04 to 0.08 inch. The coating alloy contains from zero to a total of up t about 30% by weight of at least one strong boride and carbide-forming solute metal selected from the group of refractory metals consisting of W, Mo and Cr, (preferably at least about 5% total), up to about 3% C, about 0.5% to 5% B, about 0.5% to 6% Si and the balance at least about 50% by weight of said iron-group metal (Fe, Ni and Co). The amount of carbon and boron present in said alloy is controlled to be sufficient to combine stoichiometrically with a substantial portion of said refractory metal (e.g. about 70% or more of said metal) such that the alloy coating is characterized by a thermal conductivity at substantially ambient temperature relative to silver taken as 1 of at least about 0.05 calories/sq.cm./cm/° C/sec.

One embodiment of a Yankee drier roll is depicted in FIG. 1 which is described in U.S. Pat. No. 3,228,462, the drier roll comprising a rotatable drum 10 with an outer cylindrical shell 11 of cast rion. A detail description of the drier need not be given since the sole interest is in the cylindrical surface. The drier roll has an inner cylindrical shell 12. The inner and outer shells are seperated by partitions 13 (note FIG. 2) and intermediate partitions 14 radially oriented about and longitudinally disposed relative to the length of the drum. The partitions form passages which are connected by flow diverters 15 (FIG. 2) for circulating heat transfer fluid therethrough.

The outer shell 11, inner shell 12, partitions 13 and 14 are joined to end walls or heads 16 and 17 to provide a unitary structure. The heat exchange fluid supply and return system includes a pair of axially aligned hollow axles 18 and 19 which are integral with drier heads 16 and 17. The axles have axially extending main supply and return passages 20 and 21 as shown.

Figure 2:
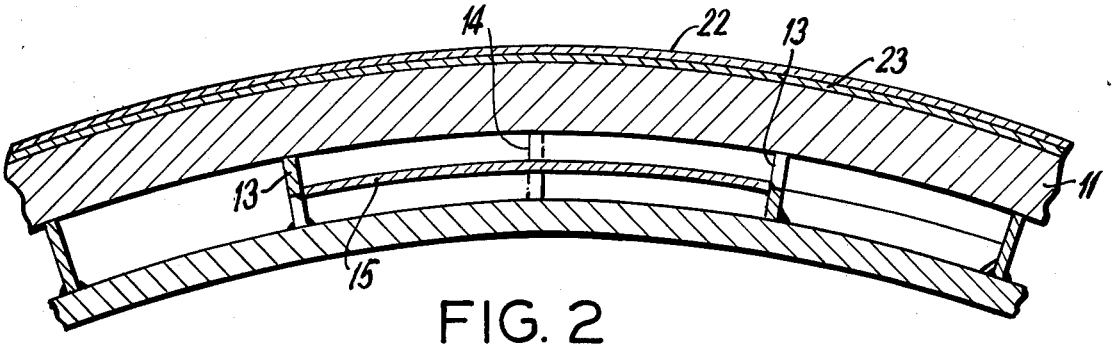
FIG. 2 depicts a partial enlarged section a portion of the cast iron shell of a Yankee drier roll showing in transverse cross section an applied alloy coating, the thickness of the coating structure being exaggerated for clarity.

A preferred coating applied to the roll surface is shown in FIG. 2 in which outer cast iron surface 11 has mechanically and metallurgically bonded to it a primary nickel-base alloy coating 22 through an intermediate or cushion coating 23 of a ductile nickel base alloy of thickness substantially less than the primary coating, the primary coating being a hard wear resistant alloy.

The specific primary coating composition employed in coating the Yankee drier roll contains by weight 0.2 to 0.4% C, 3% max Fe, 6.5 to 9.5% Cr, 2.5% B, 3% Si and the balance essentially nickel. A preferred intermediate or cushion coating is a nickel-base alloy containing 0.015% max C, 2% max Mn+Si, 7% to 9% Fe, 15% to 16.5% Cr and the balance essentially nickel. A thin layer of the latter coating is employed. The primary coat will have a higher thermal conductivity by virtue of the fact that the boron will combine with substantially all of the chromium in the alloy so that very little chromium remains in solid solution with the nickel matrix.

A preferred cushion alloy is a steel containing at least about 95% iron, the steel being particularly advantageous in that it can be applied to a substantial thickness of about 0.04 to 0.13 inch without degrading to any substantial degree the thermal conductivity, the thermal conductivity generally being over about 0.06 or 0.08 cal/cm²/cm/° C/sec. Example of such a steel is one containing by weight 0.12% C, 1% Mn+Si, 1% Cr, 0.5% Ni, 0.4% Cu and the balance iron. In its broader aspects, the steel may contain up to about 0.5% C, up to about 2% Mn+Si, up to about 2% Cr, up to about 1% Ni, up to about 1% Cu and the balance at least 95% iron.

In contrast to the foregoing, the ductile nickel-base alloy will generally be employed as a cushion layer at thicknesses below 0.04 inch.

Examples of coating alloys which may be employed in carrying out of the invention are as follows:

Table I

| Alloy No. | NICKEL-BASE HARDFACING ALLOYS PRECENT BY WEIGHT | | | | | | |
|---|---|---|---|---|---|---|---|
| | Si | B | C | Cr | Mo | W | Ni |
| 1 | 1.5 | 1.5 | — | 5 | 3 | — | balance |
| 2 | 0.5 | 2 | 2 | 15 | — | — | balance |
| 3 | 2 | 1 | 1 | — | 10 | 5 | balance |
| 4 | 2.5 | 1.5 | — | 20 | — | — | balance |

Table I-continued

| Alloy No. | NICKEL-BASE HARDFACING ALLOYS PRECENT BY WEIGHT | | | | | | |
|---|---|---|---|---|---|---|---|
| | Si | B | C | Cr | Mo | W | Ni |
| 5 | 1 | 1 | 3 | — | 5 | 15 | balance |
| 6 | 2 | 2 | 2 | 10 | — | 10 | balance |
| 7 | 1 | 4 | — | 18 | — | — | balance |

Table II

| Alloy No. | COBALT-BASE HARDFACING ALLOYS PERCENT BY WEIGHT | | | | | | |
|---|---|---|---|---|---|---|---|
| | Si | B | C | Cr | Mo | W | Co |
| 8 | 1 | 1 | 2 | 15 | — | — | bal. |
| 9 | 0.5 | 2 | 3 | — | — | 15 | bal. |
| 10 | 2 | 2 | — | 18 | — | — | bal. |
| 11 | 1 | 2 | 2 | 10 | 5 | 5 | bal. |
| 12 | 1.5 | 3 | 1 | — | 10 | 8 | bal. |
| 13 | 3 | 2 | 0.5 | 12 | 5 | — | bal. |

Table III

| Alloy No. | IRON-BASE HARDFACING ALLOYS PERCENT BY WEIGHT | | | | | | |
|---|---|---|---|---|---|---|---|
| | Si | B | C | Cr | Mo | W | Fe |
| 14 | 1 | 1 | 2 | 15 | — | — | bal. |
| 15 | 3 | 2 | — | 10 | 5 | — | bal. |
| 16 | 2 | 2 | 1 | — | 15 | 5 | bal. |
| 17 | 1 | 3 | 1 | 10 | — | 10 | bal. |
| 18 | 2 | 2 | 1 | 20 | 5 | — | bal. |
| 19 | 0.5 | 2.5 | — | — | 5 | 10 | bal. |
| 20 | 1.5 | 1.5 | 2 | 10 | — | 10 | bal. |

The foregoing nickel-base hardfacing alloys of Table I may range in composition from about 0.5 to 3% Si, about 1% to 5% B, 0 to 3% C, about 5% to 25% Cr, 0 to 15% Mo, 0to 15% W and the balance essentially nickel.

The cobalt-base hardfacing alloys of Table II may range in composition from about 0.5 to 3.5% Si, about 1% to 3% B, 0 to 3% C, about 5% to 30% Cr, 0 to 15% Mo, 0 to 15% W and the balance essentially cobalt.

The iron-base hardfacing alloys of Table III may range in composition from about 0.5 to 3% Si, about 1% to 3% B, 0 to 3% C, about 5% to 25% Cr, 0 to 15% Mo, 0 to 15% W and the balance essentially iron.

Stating it broadly, the hardfacing alloy comprises about 0.5 to 6% Si, about 0.5 to 5% B, up to 3% carbon and the balance essentially an iron-group metal from the group consisting of Fe, Ni and Co. In the case of the iron-base alloy, amounts of nickel and/or cobalt may be present, so long as the amounts do not decrease the thermal conductivity of the iron-base hardfacing alloy to substantially below 0.05. Similarly, the nickel-base hardfacing alloy may contain amounts of iron and/or cobalt, and cobalt-base hardfacing alloys may contain amounts of iron and/or nickel with substantially the same restrictions as to the thermal conductivity of the alloy.

Referring to the nickel-base hardfacing alloys in Table I, reference is made to Alloy No. 2 which contains 2% B, 2% C and 15% Cr. As chromium forms borides and carbides, a substantial portion of the solute metal chromium will be removed from solution with the nickel matrix after the coating is applied and fused in place to the ferrous metal substrate. As will be appreciated, the law of mass action will effect a redistribution of the chromium between the matrix and the boride and/or carbide reaction products, with the bulk of the chromium in the nickel matrix being reduced to substantially below 10% by weight, e.g. to 5% or below, thereby upgrading the thermal conductivity of the alloy coating relative to the ferrous metal substrate.

The boron and/or carbon are proportioned in the composition so that about 70% or more of the solute metal is combined as a compound and removed or kept from going into solid solution with the matrix alloy, the amount of solute in the matrix being substantially less than 10%.

Certain metal carbides and borides exhibit good thermal conductivities of at least about 0.05. Thus, in some instances, a two-fold effect may be obtained: (1) upgrading the thermal conductivity of the matrix alloys and (2) providing a refractory metal compound which itself may have the desired thermal conductivity.

In producing a mechanically and metallurgically bonded alloy coating on a ferrous metal drier roll, the substrate is cleaned in the usual manner. The substrate surface may be further prepared by grit blasting in which coarse plus 25 mesh chilled cast iron grit is employed, or the roll may be machine threaded to enhance further the bonding.

The coating alloys are formulated to provide melting points ranging up to about 2500° F (1371° C), the melting points ranging from about 1800° F (983° C) to 2250° F (1233° C). The melting point is controlled by the amount of silicon and boron in the alloy. The coating is applied by flame spraying an alloy powder of the composition (e.g. atomized powder). The alloy powder particle can be of a mesh size ranging from less than 125 mesh (minus 125 microns) to about 400 mesh size (about 40 microns). Mesh size referred to herein is based on U.S. Standard.

The coating is produced upon the surface of the drier roll by flame spraying utilizing a flame spray torch of the gravity feed type disclosed in U.S. Pat. No. 3,620,454. Another type of spray torch which may be employed is that disclosed in U.S. Pat. No. 3,986,668.

Tests conducted on coatings of over 0.01 inch have shown a marked increase in life compared to unprotected substrates. Large savings in downtime and maintenance costs can be realized. As stated herein, the coating thickness may range from about 0.01 to 0.15 inch thick, such as 0.04 to 0.08 inch.

A preferred method of applying an alloy coating to a ferrous metal substrate is to employ a bond coat which is also applied by metal spraying, preferably using a gravity feed torch of the type disclosed in U.S. Pat. No. 3,620,454 referred to hereinabove. The bond coat may range in thickness from about 0.002 to about 0.01 inch.

The bond coat powder is one in which each particle is an agglomerate of nickel and aluminum particles comprising 3 to 15% by weight of aluminum and the balance essentially nickel. The amount of binding resin may range from about 1% to 5% by weight of the total mixture. The agglomerates are produced using a fugitive binding agent, e.g., a decomposable organic binding agent, such as a phenolic or other similar resin. Such resins adhesively bond the ingredients together.

The average size of the agglomerate ranges from about minus 100 mesh to plus 325 mesh and, more preferably, from about minus 140 mesh to 325 mesh. In spraying the bond coat powder onto the prepared metal substrate, the aluminum in the agglomerate oxidizes in the flame to provide exothermic heat of oxidation which raises the temperature of the flame and provides a means of producing an adherent bond coat on the metal substrate to which the final coating strongly adheres.

As illustrative of the invention, the following example is given.

EXAMPLE 1

A cast iron paper drier roll about 5 feet in diameter and 14 feet long was prepared for a build-up coating. The roll was set up in a lathe and cleaned in the conventional manner. The surface was thereafter prepared for threading and a 90° V-thread cut into the surface using a tungsten carbide cutting tool. The roll was turned at about 10 RPM and the travel speed of the cutting tool set at 0.45 inch per minute. The threads were cut at 22 threads per inch at a depth of cut 0.023 inch. The use of threads aids in enhancing the bond of the overlayer to the drum surface.

Steam was passed through the interior of the roll to provide a surface temperature of the order of about 200° F to 210° F. A bond coat was applied to the surface by spraying a Ni-Al agglomerate powder containing about 4.5 to 5.5% Al, about 0.75% $CrO_3$ and the balance essentially nickel. A gravity feed spray torch was employed of the type disclosed in U.S. Pat. No. 3,620,454, said patent being incorporated herein by reference. The spray gun was mounted on a carriage moved at a travel speed across the roll at about 1 inch per minute. The aluminum in the spray powder oxidized exothermically in the flame to provide a strongly adherent bond coat of thickness of about 0.005 inch of substantially all nickel which has a high thermal conductivity of over 0.1 at ambient temperature. The bond coat being very thin is not shown in the drawings.

Following the application of the bond coat, an intermediate ductile cushion alloy coating of 0.035 inch thick is optionally applied to enhance the resistance of the hard primary alloy coat to contraction and expansion relative to the ferrous metal (cast iron) substrate, the cushion alloy containing 0.015% max C, 2% max Mn+Si, 7 to 9% Fe, 15 to 16.5% Cr and the balance essentially nickel. Alternatively, the cushion coating alloy may be a steel containing at least about 95% iron and having a thermal conductivity of substantially over 0.05.

During the various coating steps, the temperature of the drier drum is maintained in the neighborhood of about 200° F to 210° F. Following the application of the cushion or intermediate coat, the hard primary coat is next applied using the gravity feed gun referred to hereinabove.

The hard coating containing 0.2 to 0.4% C, 3% max Fe, 6.5 to 9.5% Cr, 2.5% B, 3.0% Si and the balance essentially nickel is sprayed to a thickness of about 0.07 to 0.073 inch. Note FIG. 2 which shows the primary coat 22 in bonding relationship with cushion coat 23 which in turn is bonded to the substrate via a thin bond coat not shown.

Examples of other composite drier roll structures ate shown in FIGS. 3 to 6 which are cross-sectional fragments of various other embodiments.

Figure 3:
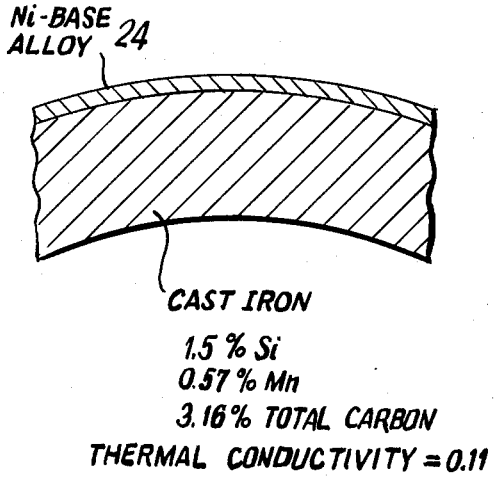
FIG. 3 is a fragment of a roll composite in cross section comprising a cast iron substrate with a nickel-base alloy coating metallurgically bonded thereto.

In the case of FIG. 3, the nickel-base hardfacing alloy comprises about 1% Si, 2% B, 1% C, 15% Cr and the balance essentially nickel. The ferrous metal substrate is a cast iron heat exchanger element containing 1.5% Si, 0.57% Mn, 3.16% total carbon and the balance iron, the substrate having a thermal conductivity of about 0.11. The surface of the element is cleaned in the usual manner followed by grit blasting with cast iron grit or threading on a lathe, a bond coat applied; and the primary alloy coating 24 sprayed onto the surface to form a coating of about 0.05 inch thick to provide a final coating which will exhibit a thermal conductivity of over 0.05.

Figure 4:
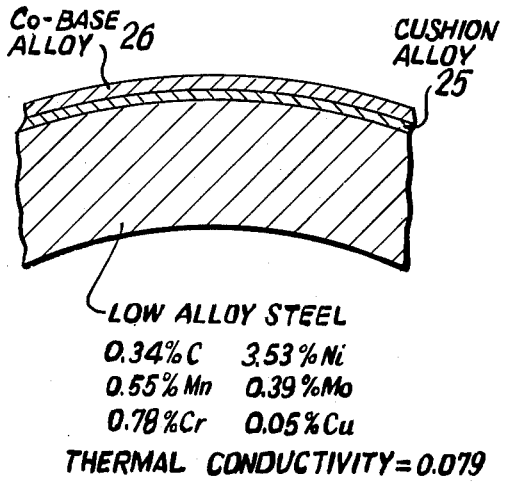
FIG. 4 is a fragmentary representation of a roll composite in cross section comprising a low alloy steel substrate having an intermediate cushion alloy with an outer coating of a cobalt-base heat resistant alloy metallurgically bonded thereto.

FIG. 4 is illustrative of another heat exchanger element comprising low alloy steel substrate coated with a cobalt-base alloy containing 1% Si, 2% B, 3% C, 25% Cr, 3% Ni, 4.5% W, 3% Mo and the balance essentially cobalt. The low alloy steel substrate contains 0.34% C, 0.55% Mn, 0.78% Cr, 3.53% Ni, 0.39% Mg, 0.05% Cu and the balance iron. This steel exhibiys a thermal conductivity of about 0.079.

The ferrous metal drum is similarly prepared and a bond coat layer applied as in Example 1 by spraying using a gravity fed torch of the type disclosed in U.S. Pat. No. 3,620,454. The bond coat powder comprises about 5% Al and 95% Ni, the aluminum particles being bonded to the core nickel powder with a phenolic resin, e.g. phenolformaldehyde. The thickness of the bond coat sprayed onto the surface is about 0.005 inch.

Following the application of the bond coat (note FIG. 2), a ductile cushion alloy is applied as in Example 1 to provide an intermediate layer 25 of about 0.03 inch thick and a cobalt-base hardfacing alloy then sprayed onto the metal substrate. The final coating 26 is characterized by a cobalt alloy matrix through which borides and carbides are dispersed, the amount of chromium remaining in solution with the cobalt being sufficiently below 10% or 5% by weight to assure optimum thermal conductivity of at least about 0.05.

Figure 5:
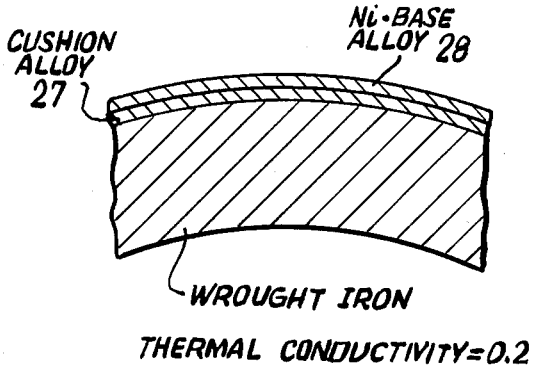
FIG. 5 is similar to FIG. 2, except that the metal substrate is wrought iron and the outer coating is a nickel-base alloy.

In FIG. 5, a wrought iron substrate is shown coated with a nickel-base hardfacing alloy, the substrate having a thermal conductivity of about 0.2. The nickel-base alloy coating comprises 3% Si, 2% B, 5% Cr, 5% Mo and the balance essentially nickel. The alloy is applied similarly as for the embodiment of FIG. 2, a bond coat being first applied, followed by a ductile steel cushion coat 27 of about 0.05 inch thick. The steel contains 0.12% C, 1% Mn+Si, 1% Cr, 0.5% Ni, 0.4% Cu and the balance iron.

The final nickel-base alloy coating 28 of thickness of about 0.05 inch will have the desired thermal conductivity by virtue of the formation of borides of the refractory solute metal chromium and molybdenum.

Figure 6:
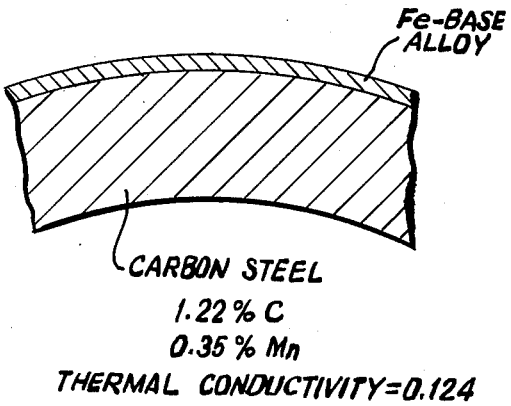
FIG. 6 shows a fragment of a carbon steel substrate with an iron-base alloy coating metallurgically bonded thereto in accordance with the invention.

FIG. 6 shows a composite in which the ferrous metal substrate is a carbon steel containing 1.22% C, 0.35% Mnand the balance iron, the steel substrate exhibiting a thermal conductivity of about 0.124. The iron-base hardfacing alloy coating contains about 3% Si, 2% B, 10% Cr, 5% Mo and the balance essentially iron. This coating is applied to the carbon steel substrate similarly as described in FIG. 1.

An important property of a coating is its resistance to flaking, spalling, etc. Thus, it is desirable that the relative coefficient of expansion between the final coating and the ferrous metal substrate should be within the range of plus 50% minus 30%. Assuming the ferrous metal substrate to have a coefficient of expansion referred to ambient temperature of about $11\times10^{-6}$ inch/inch° C, the alloy coating may have a coefficient of expansion ranging from about 7.7 to about 16 or $17\times10^{-6}$ in/in/° C, so long as the alloy coating is preferably mechanically and metallurgically bonded to the ferrous metal substrate through a ductile nickel-base cushion alloy of the type referred to hereinabove or a steel coating containing at least 95% iron. The ductile nickel-base cushion alloy preferably has a composition ranging up to about 0.025 max carbon, 2% max Mn+Si, about 5% to 15% Fe, about 5% to 20% Cr and the balance essentially nickel, the thickness of the alloy being less than about 0.05 inch.

Summarizing the foregoing, the invention provides, as an article of manufacture, a composite ferrous metal drier roll having a hardfacing coating mechanically and metallurgically bonded to the surface thereof characterized by adequate thermal conductivity relative to the ferrous metal surface of the roll.

As stated hereinbefore, the primary coating of the hardfacing alloy may be bonded either directly to the ferrous metal substrate or through the agency of an intermediate ductile cushion alloy, e.g. a ductile nickel-base alloy thickness less than 0.05 inch or said steel cushion layer of thickness ranging from about 0.04 to 0.13 inch.

Although the present invention has been described in conjunction with preferred embodiments, it is to be understood that modifications and variations may be resorted to without departing from the spirit and scope of the invention as those skilled in the art will readily understand. Such modifications and variations are considered to be within the purview and scope of the invention and the appended claims.

What is claimed is:

1. A composite drier roll having a cylindrical ferrous metal surface with a primary hardfacing alloy coating mechanically and metallurgically bonded thereto, said ferrous metal substrate having a thermal conductivity relative to silver taken as 1 as substantially ambient temperature of at least about 0.06 calories/sq.cm/cm/° C/sec, said primary alloy coating being a flame sprayed heat, corrosion and wear resistant iron-group metal-base alloy having a thickness ranging from about 0.01 to 0.15 inch, said hardfacing alloy consisting essentially of a total of up to about 30% by weight of a strong boride and carbide-forming solute metal in amounts ranging from about 5% to 25% Cr, 0 to about 15% Mo, 0 to about 15% W, up to about 3% C, about 0.5% to 5% B, about 0.5% to 6% Si and the balance essentially said iron-group metal, the amount of boron or carbon present in said alloy being sufficient to combine with a substantial amount of said refractory metal to provide a mechanically and metallurgically bonded alloy coating having a thermal conductivity at substantially ambient temperature relative to silver taken as 1 of at least about 0.05 calories/sq.cm/cm° C.sec.

2. The composite drier roll of claim 1, wherein the metal surface is cast iron.

3. The composite drier roll of claim 1, including a ductile alloy layer intermediate the primary alloy coating and said ferrous metal surface, said ductile alloy being selected from the group consisting of a ductile nickel-base alloy of thickness less than the primary coat and less than 0.05 inch in thickness and a steel containing at least 95% iron and having a thickness ranging from about 0.01 to 0.13 inch.

4. The composite drier roll of claim 2, wherein the primary coating alloy is a nickel-base hardfacing alloy containing about 0.5 to 3% Si, about 1% to 5% B and 0 to 3% C.

5. The composite drier roll of claim 2, wherein the primary coating alloy is a cobalt-base hardfacing alloy containing about 0.5 to 3.5% Si, about 1 to 3% B and 0 to 3% C.

6. The composite drier roll of claim 2, wherein the primary coating alloy is an iron-base hardfacing alloy containing about 0.5 to 3% Si, about 1 to 3% B and 0 to 3% C.

7. A composite drier roll having a cylindrical ferrous metal surface with a primary hardfacing alloy coating mechanically and metallurgically bonded thereto through an intermediate ductile metal cushion coating, said ferrous metal surface having a thermal conductivity relative to silver taken as 1 at substantially ambient temperature of at least about 0.06 calories/sq.cm/cm/° C/sec, said primary alloy coating being a flame sprayed heat, corrosion and wear resistant iron-group metal-base alloy having a thickness ranging from about 0.01 to 0.15 inch, said hardfacing alloy consisting essentially of a total of up to about 30% by weight of a strong boride and carbideforming solute metal in amounts ranging from 5% to 25% Cr, 0 to about 15% Mo, 0 to about 15% W, up to about 3% C, about 0.5 to 5% B, about 0.5 to 6% Si and the balance essentially an iron-group metal, the amount of boron or carbon present in said alloy being sufficient to combine with a substantial amount of said refractory solute metal when present to provide a mechanically and metallurgically bonded alloy coating having a thermal conductivity at substantially ambient temperature relative to silver taken as 1 of at least about 0.05 calories/ sq.cm./cm/° C/sec, said intermediate ductile metal cushion coating being selected from the group consisting of a ductile nickel-base alloy coating of thickness less than the primary coat and less than about 0.05 inch and a steel containing at least 95% iron and having a thickness ranging from about 0.01 to 0.13 inch.

8. The composite drier roll of claim 7, wherein the ferrous metal surface is cast iron.

9. The composite drier roll of claim 7, wherein the primary coating alloy is a nickel-base alloy containing about 0.5% to 3% Si, about 1% to 5% B, 0 to 3% C and the balance essentially nickel.

10. The composite drier roll of claim 7, wherein the primary coating alloy is a cobalt-base alloy containing about 0.5 to 3.5% Si, about 1 to 3% B, 0 to 3% C and the balance essentially cobalt.

11. The composite drier roll of claim 7, wherein the primary coating alloy is an iron-base alloy containing about 0.5 to 3% Si, about 1 to 3% B, 0 to 3% C and the balance essentially iron.

* * * * *